US011879452B2

(12) United States Patent
Iwanaji et al.

(10) Patent No.: US 11,879,452 B2
(45) Date of Patent: Jan. 23, 2024

(54) PUMP DISPLACEMENT CONTROL DEVICE HAVING A FEEDBACK LEVER

(71) Applicant: KYB Corporation, Tokyo (JP)

(72) Inventors: Tetsuya Iwanaji, Kanagawa (JP); Hiroaki Kuboi, Kanagawa (JP); Rintaro Matsuda, Kanagawa (JP)

(73) Assignee: KYB CORPORATION, Tokyo (JP)

( * ) Notice: Subject to any disclaimer, the term of this patent is extended or adjusted under 35 U.S.C. 154(b) by 193 days.

(21) Appl. No.: 17/439,186

(22) PCT Filed: Feb. 13, 2020

(86) PCT No.: PCT/JP2020/005639
§ 371 (c)(1),
(2) Date: Sep. 14, 2021

(87) PCT Pub. No.: WO2020/195299
PCT Pub. Date: Oct. 1, 2020

(65) Prior Publication Data

US 2022/0154715 A1 May 19, 2022

(30) Foreign Application Priority Data

Mar. 22, 2019 (JP) ..... 2019-055068

(51) Int. Cl.

| | |
|---|---|
| ***F04B 49/12*** | (2006.01) |
| *F04B 49/00* | (2006.01) |
| *F04B 1/122* | (2020.01) |
| *F04B 49/08* | (2006.01) |
| *F04B 49/22* | (2006.01) |

(52) U.S. Cl.
CPC ..... *F04B 49/12* (2013.01); *F04B 1/122* (2013.01); *F04B 49/002* (2013.01); *F04B 49/08* (2013.01); *F04B 49/22* (2013.01)

(58) Field of Classification Search
CPC ..... F04B 1/26; F04B 1/32; F04B 1/12; F04B 1/122; F04B 1/34
See application file for complete search history.

(56) References Cited

U.S. PATENT DOCUMENTS

| | | | | |
|---|---|---|---|---|
| 5,273,403 A * | 12/1993 | Im | F04B 1/324 91/384 |
| 9,022,749 B2 * | 5/2015 | Akiyama | E02F 9/123 417/212 |
| 2015/0337813 A1 * | 11/2015 | Iwanaji | F04B 1/324 417/222.1 |

FOREIGN PATENT DOCUMENTS

| | | | |
|---|---|---|---|
| EP | 0576727 A1 | 1/1994 | |
| JP | H01-116294 A | 5/1989 | |
| KR | 10 1510397 * | 4/2015 | F04B 1/324 |

(Continued)

*Primary Examiner* — Nathan C Zollinger
*Assistant Examiner* — Timothy P Solak
(74) *Attorney, Agent, or Firm* — Rabin & Berdo, P.C.

(57) ABSTRACT

A pump displacement control device includes: a servo piston that changes a tilt angle; a flow rate control spool that is displaced corresponding to an input pressure; a power control spool that is displaced corresponding to a discharge pressure of the pump; a control pressure regulating spool that regulates a control pressure which controls the servo piston; and a feedback lever connected to the servo piston and the control pressure regulating spool. The feedback lever directly abut on either one of the flow rate control spool or the power control spool for regulating the control pressure.

3 Claims, 13 Drawing Sheets

(56) References Cited

FOREIGN PATENT DOCUMENTS

KR 10-1510397 B1 4/2015

* cited by examiner

PUMP DISPLACEMENT CONTROL DEVICE HAVING A FEEDBACK LEVER

TECHNICAL FIELD

The present invention relates to a pump displacement control device.

BACKGROUND ART

There has been known a pump displacement control device which controls displacement of a pump by changing a tilt angle of a variable displacement pump (see JP H01-116294A). The pump displacement control device described in JP H01-116294A includes a servo cylinder mechanism, a spool valve mechanism which drives the servo cylinder mechanism, a pilot spool mechanism for a flow rate control, and a pilot spool mechanism for a power control.

The pilot spool mechanism for the flow rate control is a mechanism which performs the flow rate control for controlling a displacement of the pump on the basis of an external pilot pressure. The pilot spool mechanism for the power control is a mechanism which performs the power control and decreases the displacement of the pump along with the increase of a discharge pressure of the pump. The power control is a control performed for preventing an engine stall by controlling the displacement of the pump so that power necessary for driving the pump does not exceed an output of an engine which is a drive source of the pump.

The pump displacement control device described in JP H01-116294A includes a link mechanism which can select a control between the flow rate control and the power control such that the control which requires a smaller displacement is performed with priority. The link mechanism includes the flow rate control lever which transmits an operation of a spool of the pilot spool mechanism for the flow rate control to a spool of the spool valve mechanism by way of a feedback lever, and a power control lever which transmits an operation of a spool of the pilot spool mechanism for the power control to the spool of the spool valve mechanism by way of the feedback lever.

SUMMARY OF INVENTION

In the pump displacement control device described in JP H01-116294A, an operation of the flow rate control spool and an operation of the power control spool are transmitted to the spool of the spool valve mechanism by way of the link mechanism including the flow rate control lever and the power control lever. Accordingly, in the pump displacement control device described in JP H01-116294A, there is a concern that an operational responsiveness of the spool of the spool valve mechanism is deteriorated due to a transmission delay caused by a play or a friction of the link mechanism. As a result, there arises a drawback that it is difficult to properly control the displacement of the pump. Further, the link mechanisms are complicated and require a large number of parts and hence, there also arises a drawback that a cost of the pump displacement control device is pushed up.

It is an object of the present invention to provide a pump displacement device which can properly control a displacement of a pump and can be manufactured at a low cost.

According to one aspect of the present invention, a pump displacement control device for controlling a displacement of a pump includes: a servo piston configured to change a tilt angle of the pump; a flow rate control spool configured to be displaced corresponding to an input pressure; a power control spool configured to be displaced corresponding to a discharge pressure of the pump; a control pressure regulating spool configured to regulate a control pressure which controls the servo piston corresponding to a displacement of the flow rate control spool and a displacement of the power control spool; and a feedback lever connected to the servo piston and the control pressure regulating spool, the feedback lever being configured to feedback a displacement of the servo piston to the control pressure regulating spool. The feedback lever is configured to directly abut on either one of the flow rate control spool or the power control spool for regulating the control pressure.

DESCRIPTION OF EMBODIMENTS

Pump displacement control devices according to embodiments of the present invention are described with reference to drawings.

The pump displacement control device is a device which controls displacement (displacement volume) by changing a tilt angle of a variable displacement pump.

Figure 1:
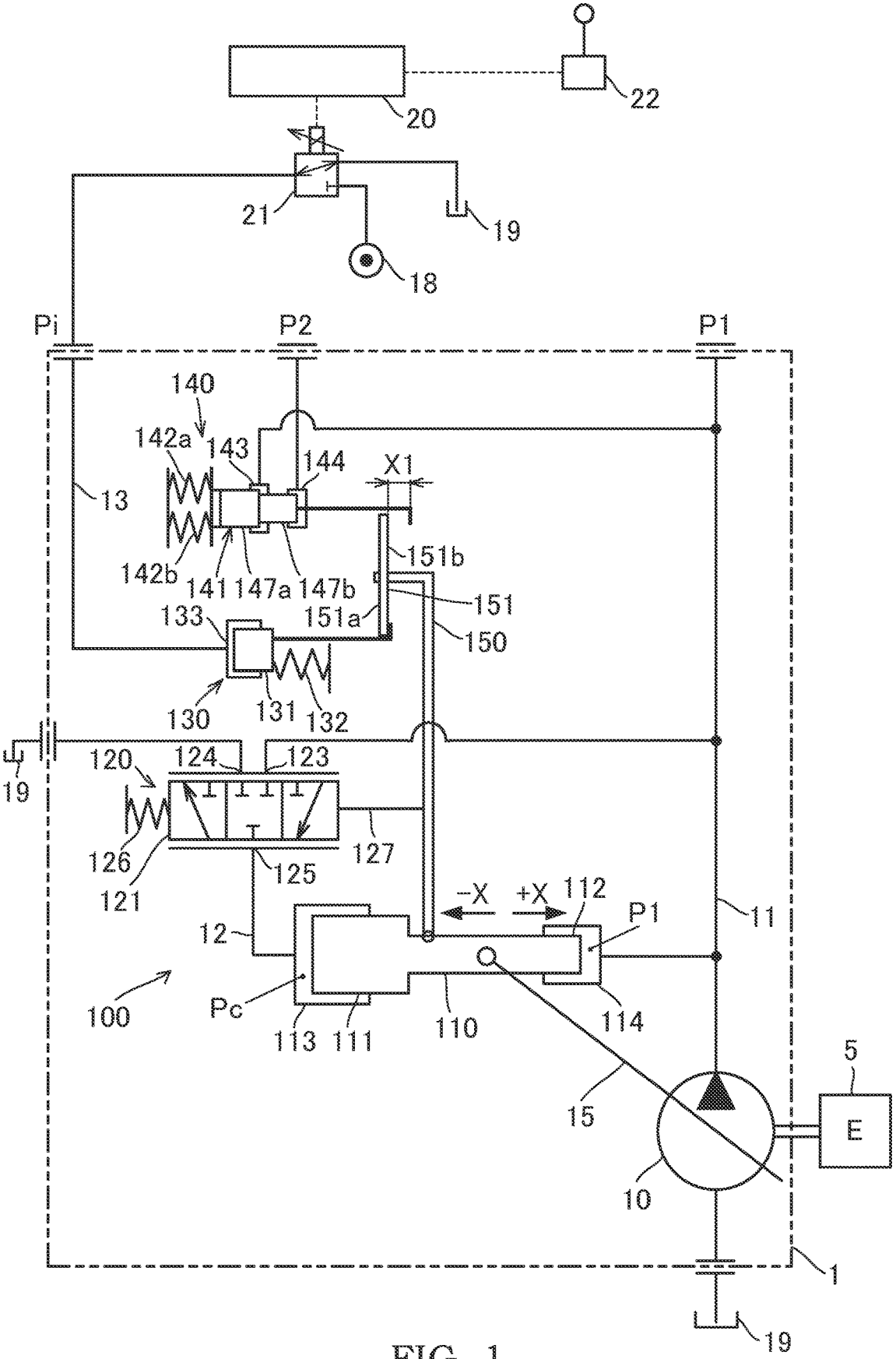
FIG. 1 is a hydraulic circuit diagram illustrating the configuration of a pump device provided with a pump displacement control device according to the present embodiment.

FIG. 1 is a hydraulic circuit diagram illustrating the configuration of a pump device 1 provided with a pump displacement control device 100 according to the present embodiment. As illustrated in FIG. 1, the pump device 1 includes a variable displacement pump 10, and the pump displacement control device 100 which controls a displacement (displacement volume) of the pump 10. Displacement of the pump 10 is a discharge amount of a working fluid per one rotation of the pump 10. Hereinafter, displacement of the pump 10 is also referred to as "pump displacement".

In the pump device 1 according to the present embodiment, a working oil is used as a working fluid. In place of a working oil, other working fluids such as working water and water soluble alternative liquid may be used. The pump device 1 is provided as a pressure source of a hydraulic equipment mounted on a construction machine such as a hydraulic excavator.

The pump 10 is a swash plate piston pump capable of changing the displacement corresponding to a tilt angle of a swash plate 15. The pump 10 is rotatably driven by an engine 5 serving as a drive source. The pump 10 sucks the working oil stored in a tank 19, and discharges a pressurized working oil (pressurized oil) to a discharge passage 11. The working oil discharged from the pump 10 is supplied to a hydraulic equipment of a construction machine not illustrated in the drawing. Examples of the hydraulic equipment of the construction machine include a hydraulic cylinder which drives a boom, an arm, or a bucket of a hydraulic excavator, and a hydraulic motor which drives a crawler of a hydraulic excavator.

A controller 20 which controls respective parts of the construction machine is mounted on the construction machine. A manipulation sensor 22 which is a detection device adapted to detect a manipulation variable of a manipulation lever manipulated by an operator is connected to the controller 20.

The controller 20 controls an electromagnetic proportional control valve 21 on the basis of a detection result of the manipulation sensor 22. The electromagnetic proportional control valve 21 decreases a pressure of the working oil supplied from an oil pressure source 18 corresponding to a control current from the controller 20, and outputs the pressure to the pump displacement control device 100. The electromagnetic proportional control valve 21 is, for example, a positive-proportional-type electromagnetic proportional control valve where the larger a control current which excites a solenoid becomes, the larger a secondary pressure outputted from the electromagnetic proportional control valve 21 becomes. Hereinafter, the secondly pressure which is outputted from the electromagnetic proportional control valve 21 and is inputted to the pump displacement control device 100 is referred to as "input pressure Pi".

The controller 20 controls a pump displacement on the basis of an manipulation variable of the manipulation lever which is detected by the manipulation sensor 22. In a memory part of the controller 20, a data table of control current values corresponding to manipulation variables of the manipulation lever is stored. The controller 20 looks up the data table, and calculates a control current value corresponding to a manipulation variable of the manipulation lever. The controller 20 controls the electromagnetic proportional control valve 21 such that the larger a manipulation variable of the manipulation lever detected by the manipulation sensor 22 becomes, the larger a control current value with respect to the electromagnetic proportional control valve 21 becomes. That is, the controller 20 controls the electromagnetic proportional control valve 21 such that the larger a manipulation variable of the manipulation lever becomes, the larger a pump displacement becomes or the larger the input pressure Pi becomes.

The pump displacement control device 100 is configured to perform a flow rate control where the displacement of the pump 10 is controlled on the basis of the input pressure Pi. In a flow rate control state, the pump displacement control device 100 controls the tilt angle of the swash plate 15 of the pump 10 such that the larger the input pressure Pi becomes, the larger the displacement of the pump 10 becomes.

The pump displacement control device 100 is also configured to perform a power control where the displacement of the pump 10 is controlled on the basis of a discharge pressure P1 of the pump 10 and a discharge pressure P2 of another pump driven by the engine 5. In the present embodiment, the power control is a control for preventing an engine stall where the displacement of the pump is controlled such that power necessary for driving the pumps (in this embodiment, the pump 10 driven by the engine 5 and the another pump different from the pump 10) does not exceed an output of the engine 5. In a power control state, the pump displacement control device 100 controls the tilt angle of the swash plate 15 of the pump 10 such that the larger the discharge pressures P1, P2 become, the smaller the displacement of the pump 10 becomes.

The pump displacement control device 100 selects the control where the displacement of the pump 10 becomes small out of the flow rate control and the power control, and performs the selected control. That is, the pump displacement control device 100 performs the control where the displacement of the pump 10 becomes small with priority. Accordingly, in a case where a load pressure is increased when the flow rate control is undergoing, the power control is performed in place of the flow rate control so that the tilt angle of the pump 10 is decreased whereby an overload applied to the engine 5 can be prevented. Hereinafter, the pump displacement control device 100 is described in detail.

The pump displacement control device 100 includes: a servo piston 110 which is connected to the swash plate 15 of the pump 10 and changes the tilt angle of the pump 10; a control pressure regulating valve 120 which regulates a control pressure Pc for controlling the displacement of the servo piston 110; a flow rate control mechanism 130 which is provided for performing the flow rate control for controlling the displacement of the pump 10 on the basis of the input pressure Pi; and a power control mechanism 140 provided for performing the power control for controlling the displacement of the pump 10 on the basis of discharge pressures P1, P2.

The control pressure regulating valve 120 includes a control pressure regulating spool 121, and an accommodating hole 175 (see FIG. 3) which accommodates the control pressure regulating spool 121. The control pressure regulating valve 120 includes a pump port 123 connected to the discharge passage 11, a tank port 124 connected to the tank 19 through a drain passage, and a control pressure port 125 connected to a large diameter side chamber 113 described later through a control pressure passage 12.

The control pressure regulating valve 120 has a pump communication position, an interruption position, and a tank communication position. The pump communication position is a position where the pump port 123 and the control pressure port 125 communicate with each other, and the communication between the tank port 124 and the control pressure port 125 is interrupted. The tank communication position is a position where the tank port 124 and the control pressure port 125 communicate with each other, and the communication between the pump port 123 and the control pressure port 125 is interrupted. The interruption position is a position where the communication between the pump port 123 and the control pressure port 125 is interrupted, and the communication between the tank port 124 and the control pressure port 125 is interrupted.

The control pressure regulating valve 120 further includes: a spring 126 serving as a biasing member for biasing the control pressure regulating spool 121 in a direction for changing the position from the pump communication position to the tank communication position; and a connecting portion 127 which is connected to a feedback lever 150.

The servo piston 110 is connected to the swash plate 15, and the tilt angle of the swash plate 15 is changed corresponding to the movement of the servo piston 110. The servo piston 110 has a large diameter portion 111 formed on one end side of the servo piston 110 in the axial direction, and a small diameter portion 112 formed on the other end side of the servo piston 110 in the axial direction. An outer diameter of the large diameter portion 111 is larger than an outer diameter of the small diameter portion 112.

In a pump housing 30 (see FIG. 2), the large diameter side chamber 113 being a pressure chamber that the large diameter portion 111 of the servo piston 110 faces, and a small diameter side chamber 114 being a pressure chamber that the small diameter portion 112 of the servo piston 110 faces are formed. A pressure receiving surface area of the servo piston 110 on which a pressure in the large diameter side chamber 113 acts is larger than a pressure receiving surface area of the servo piston 110 on which a pressure in the small diameter side chamber 114 acts. The large diameter side chamber 113 is connected to the control pressure port 125 of the control pressure regulating valve 120 through the control pressure passage 12, and the small diameter side chamber 114 is connected to the discharge passage 11 of the pump 10.

When the control pressure regulating valve 120 is switched to the pump communication position, a working oil is introduced into the large diameter side chamber 113 through the control pressure regulating valve 120 so that a pressure in the large diameter side chamber 113 rises. When the control pressure regulating valve 120 is switched to the tank communication position, the working oil is discharged from the large diameter side chamber 113 into the tank 19 through the control pressure regulating valve 120 so that the pressure in the large diameter side chamber 113 is lowered. When the control pressure regulating valve 120 is switched to the interruption position, the pressure in the large diameter side chamber 113 is maintained at a certain pressure.

When the pressure in the large diameter side chamber 113 becomes larger than a predetermined pressure, the servo piston 110 moves toward one side (+X direction in the drawing). With such movement of the servo piston 110, the tilt angle of the pump 10 is decreased. That is, the displacement of the pump 10 is decreased. When the pressure in the large diameter side chamber 113 becomes smaller than the predetermined pressure, the servo piston 110 moves toward the other side (−X direction in the drawing). With such movement of the servo piston 110, the tilt angle of the pump 10 is increased. That is, the displacement of the pump 10 is increased. In other words, the servo piston 110 is controlled corresponding to the pressure in the large diameter side chamber 113. Accordingly, hereinafter, "the pressure in the large diameter side chamber 113" regulated by the displacement of the control pressure regulating spool 121 is referred to as "control pressure Pc".

The pump displacement control device 100 further includes the feedback lever 150 which is connected to the servo piston 110 and the control pressure regulating spool 121. The feedback lever 150 feedbacks the displacement of the servo piston 110 to the control pressure regulating spool 121.

The servo piston 110 is connected to the control pressure regulating spool 121 by way of the feedback lever 150. With such a configuration, in the pump displacement control device 100, while the flow rate control or the power control is performed, a feedback control where the displacement of the control pressure regulating valve 120 is regulated corresponding to the tilt angle of the pump 10 is performed.

Figure 2:
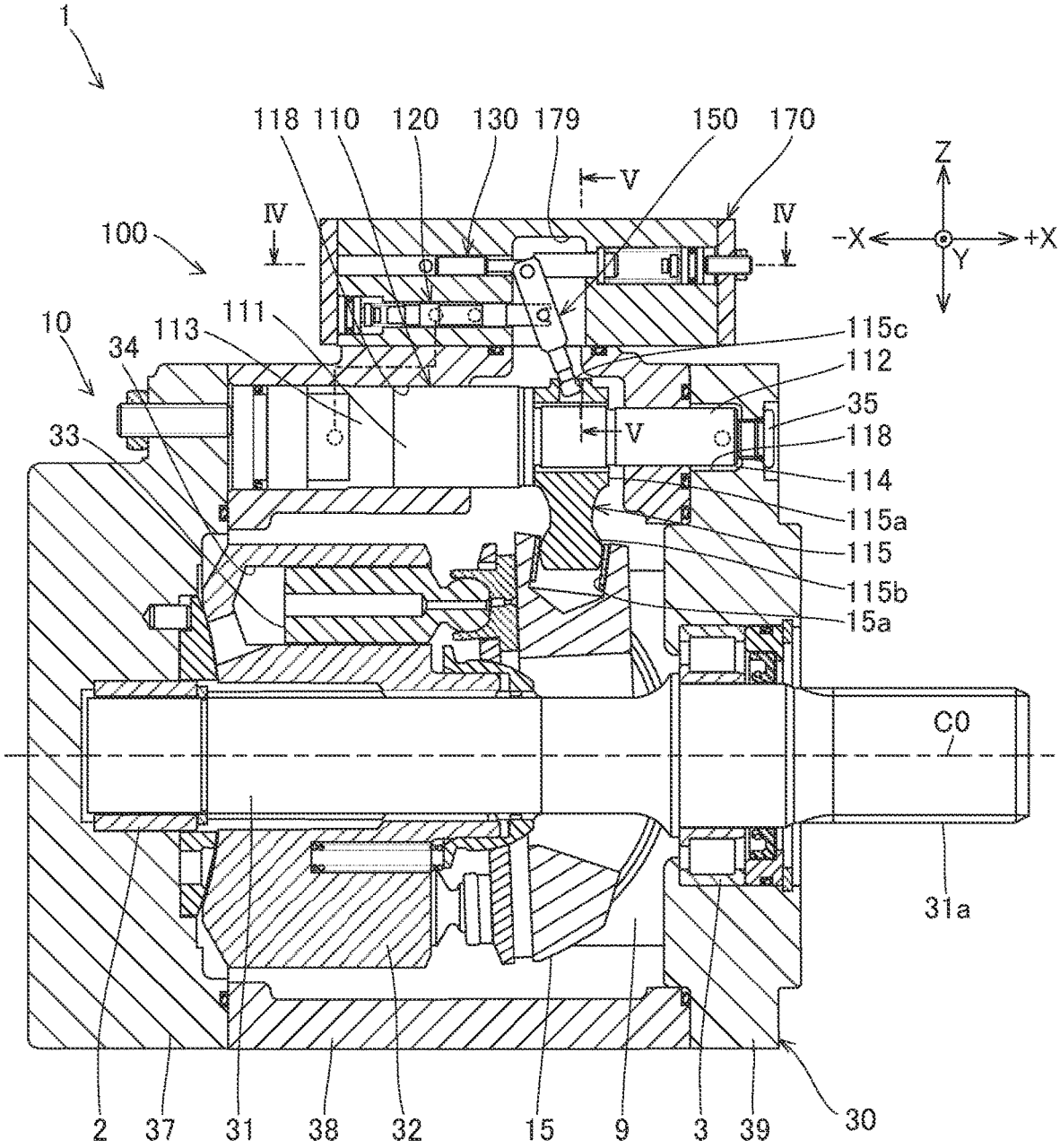
FIG. 2 is a cross-sectional view of the pump device illustrating a state where a displacement of a pump is minimum.

As illustrated in FIG. 2, the pump 10 includes: a cylinder block 32 which is rotatably driven by the engine 5 (see FIG. 1); pistons 33 which move in a reciprocating manner in a plurality of cylinders 34 disposed in the cylinder block 32; and the swash plate 15 which the pistons 33 follow.

The cylinder block 32 and the swash plate 15 are housed in the pump housing 30. The pump housing 30 includes a cylindrical body portion 38, a pump base 37 which closes an opening formed on one end side of the body portion 38, and a pump cover 39 which closes an opening formed on the other end side of the body portion 38.

A shaft 31 is fixedly mounted in the cylinder block 32. A proximal end portion 31*a* of the shaft 31 is connected to an output shaft of the engine 5 (see FIG. 1). A distal end portion of the shaft 31 is rotatably supported on the pump base 37 by way of a bearing 2, and a center portion of the shaft 31 is rotatably supported on the pump cover 39 by way of a bearing 3.

The swash plate 15 is swingably supported on the pump housing 30 by way of a tilt bearing 9. In the pump 10 according to this embodiment, when the tilt angle of the swash plate 15 changes, strokes of the pistons 33 with respect to the cylinders 34 change so that the pump displacement changes.

The structure of the pump displacement control device 100 is described in detail with reference to FIG. 2 to FIG. 5. Hereinafter, for the sake of convenience of the description, an X axis, a Y axis and a Z axis are defined as illustrated in the drawings. The X axis, the Y axis and the Z axis are orthogonal to each other. Further, a direction parallel to the X axis is expressed as an X axis direction, a direction parallel to the Y axis is expressed as a Y axis direction, and a direction parallel to the Z axis is expressed as a Z axis direction. The X axis is an axis parallel to a rotation center axis CO of the cylinder block 32. The Y axis is an axis parallel to a swinging center axis of the swash plate 15. One X axis direction directed toward a pump cover 39 side from a pump base 37 side is expressed as +X direction, and the other X axis direction which is a direction opposite to +X direction is expressed as −X direction.

As illustrated in FIG. 2, a piston housing portion 118 which slidably houses the servo piston 110 is formed in the body portion 38 of the pump housing 30. The servo piston 110 is disposed parallel to the X axis, and slides in the piston housing portion 118 in the X axis direction. A connecting member 115 is mounted on the servo piston 110. The connecting member 115 includes: a cylindrical fastening portion 115*a* fastened to the servo piston 110 by screws; a protruding portion 115*b* protruding in one Z axis direction (downward in the drawing) from the fastening portion 115*a*; and a connecting groove 115*c* disposed on a side opposite to the protruding portion 115*b*.

The protruding portion 115*b* is slidably and rotatably connected to the connecting groove 15*a* formed in the swash plate 15. With such a configuration, when the servo piston 110 slides in the X axis direction, a drive force of the servo piston 110 is transmitted to the swash plate 15 by way of the protruding portion 115*b* so that the swash plate 15 is swung whereby the tilt angle of the swash plate 15 changes.

Figure 3:
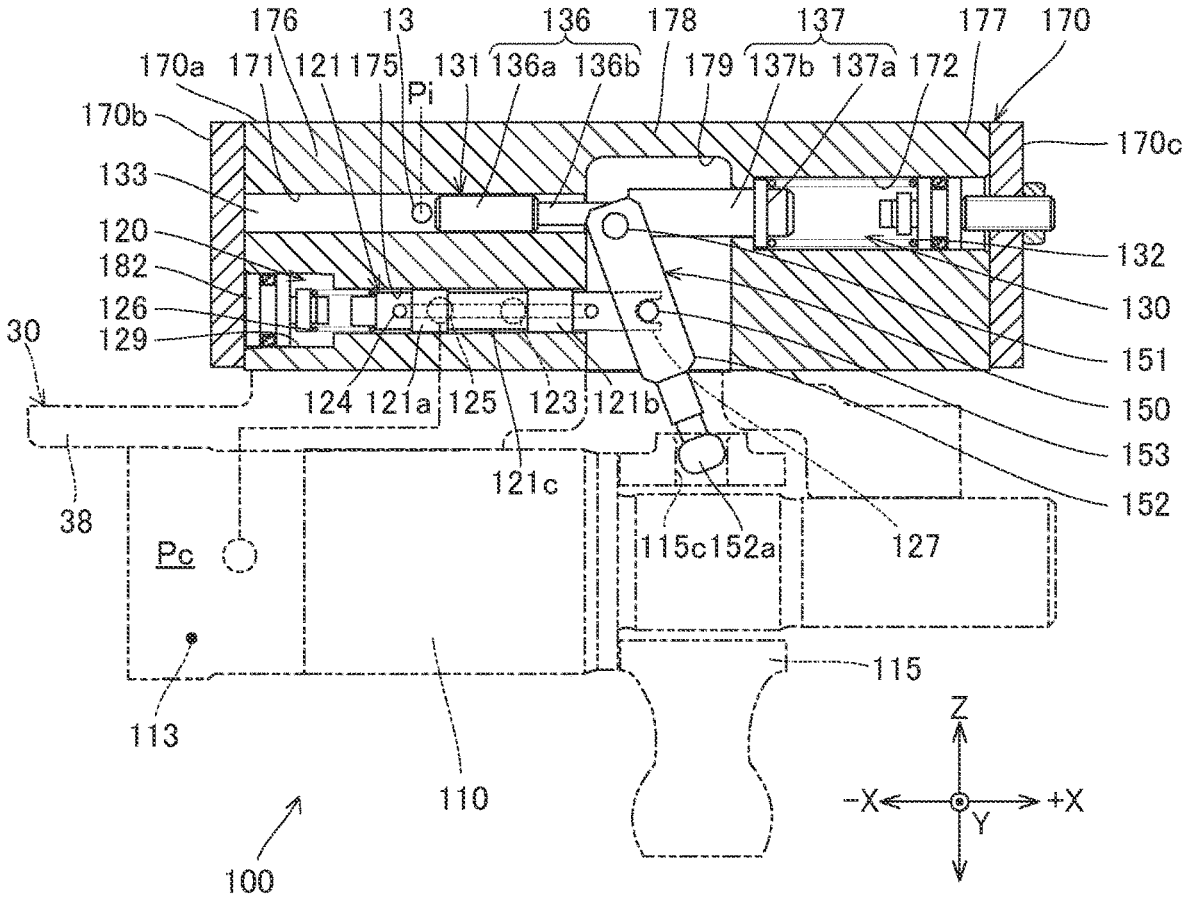
FIG. 3 is a view illustrating the pump displacement control device in FIG. 2 in an enlarged manner.

As illustrated in FIG. 3, one end portion of the feedback lever 150 is slidably and rotatably connected to the connection groove 115*c* of the connecting member 115. Since the feedback lever 150 is connected to the connecting portion 127 of the control pressure regulating spool 121, when the servo piston 110 moves, a drive force of the servo piston 110 is transmitted to the control pressure regulating spool 121 by way of the feedback lever 150 and hence, the control pressure regulating spool 121 also moves. The detail of the structure of the feedback lever 150 is described later.

The pump displacement control device 100 includes a regulator housing 170 mounted on the body portion 38 of the pump housing 30. The flow rate control mechanism 130, the power control mechanism 140 (see FIG. 4A) and the control pressure regulating valve 120 are disposed in the regulator housing 170.

Figure 4A:
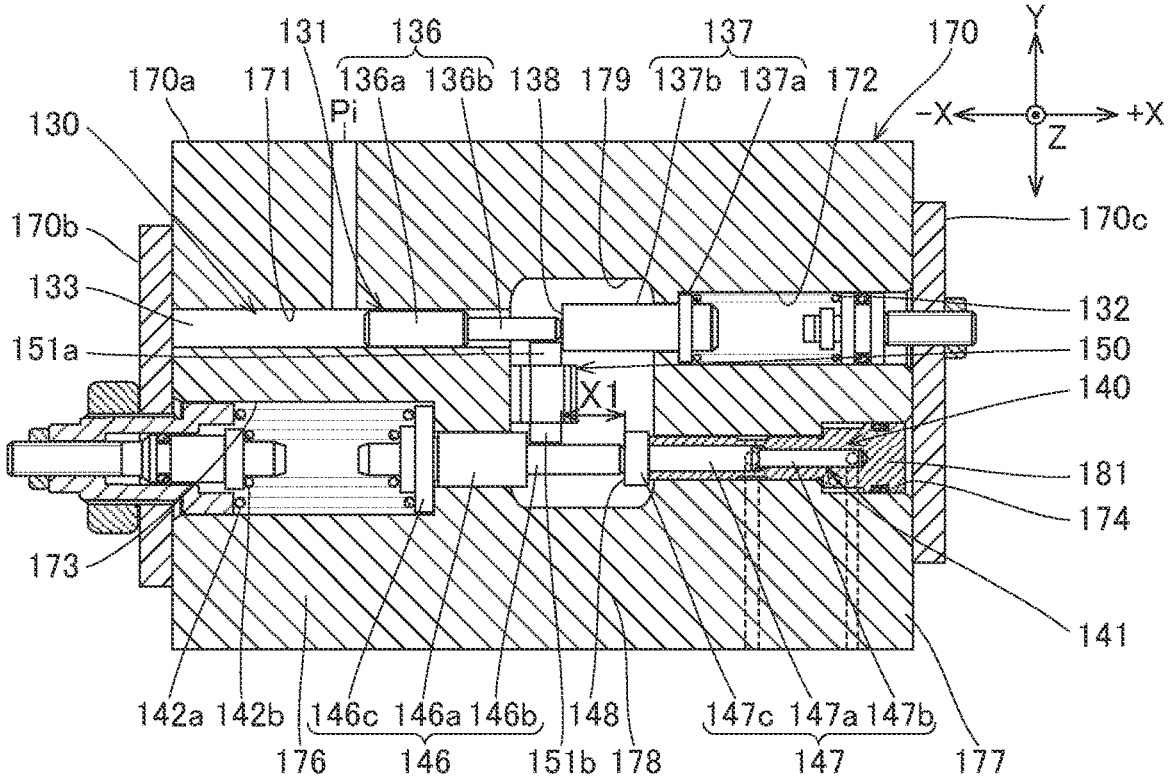
FIG. 4A is a cross-sectional view taken along a line IV-IV in FIG. 2.
Figure 5:
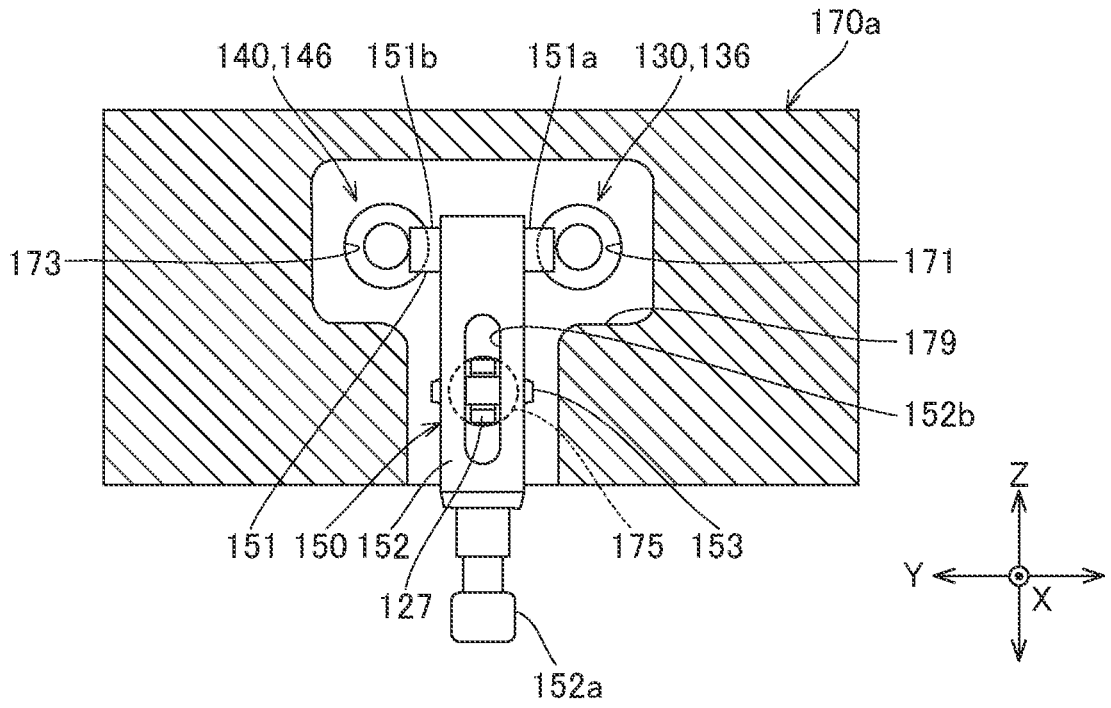
FIG. 5 is a cross-sectional view taken along a line V-V in FIG. 2.

As illustrated in FIG. 3 and FIG. 4A, the regulator housing 170 includes a body portion 170*a* having a rectangular parallelepiped shape, and covers (a first cover 170*b* and a second cover 170*c*) having a rectangular flat plate shape which are mounted on both ends of the body portion 170*a*. As illustrated in FIG. 3, FIG. 4A, and FIG. 5, in the body portion 170*a*, a housing chamber 179 which opens on a mounting surface of the pump housing 30, and a plurality of housing portions (a first housing hole 171, a second housing hole 172, a third housing hole 173, a fourth housing hole 174, and a fifth housing hole 175) are formed.

The respective housing holes 171 to 175 are formed in the X axis direction in a penetrating manner. That is, the respective housing holes 171 to 175 open in the housing chamber 179, and open on end surfaces of the body portion 170*a*. The first housing hole 171 and the second housing hole 172 are housing portions in which a flow rate control spool 131 described later is housed, and the first housing hole 171 and the second housing hole 172 have coaxial circular cross-sections respectively. The third housing hole 173 and the fourth housing hole 174 are housing portions in which a power control spool 141 described later is housed, and the third housing hole 173 and the fourth housing hole 174 have coaxial circular cross sections respectively. The fifth housing hole 175 is a housing portion in which the control pressure regulating spool 121 is housed. The housing chamber 179 is a housing portion in which the feedback lever 150 is housed. Openings of the respective housing holes 171 to 175 formed on the end surfaces of the body portion 170*a* are closed by the covers 170*b*, 170*c*, plugs and the like.

As illustrated in FIG. 3, the housing chamber 179 in the body portion 170*a* is formed such that the housing chamber 179 faces the connecting groove 115*c* of the servo piston 110. In other words, the housing chamber 179 in the body portion 170*a* is formed such that the housing chamber 179 faces the swash plate 15 (see FIG. 2) with the servo piston 110 sandwiched between the housing chamber 179 and the swash plate 15.

As illustrated in FIG. 3 and FIG. 4A, a portion of the body portion 170*a* on a −X direction side with respect to the housing chamber 179 is referred to as a first block 176, and a portion of the body portion 170*a* on a +X direction side with respect to the housing chamber 179 is referred to as a second block 177. As described above, the body portion 170*a* is divided into the first block 176 and the second block 177 by the housing chamber 179, and the first block 176 and the second block 177 are connected to each other by a connecting block 178.

The flow rate control mechanism 130 includes: a pressure chamber 133 into which the input pressure Pi is introduced from the electromagnetic proportional control valve 21 (see FIG. 1) through an input pressure passage 13; the flow rate control spool 131 which shifts corresponding to the input pressure Pi; and a spring 132 serving as a biasing member for biasing the flow rate control spool 131 against a pressure in the pressure chamber 133.

The flow rate control spool 131 is disposed parallel to the X axis. One end side (a left end side in the drawing) of the flow rate control spool 131 is slidably housed in the first housing hole 171 formed in the first block 176 of the regulator housing 170. The other end side (a right end side in the drawing) of the flow rate control spool 131 is slidably housed in the second housing hole 172 formed in the second block 177 of the regulator housing 170. A spring 132 is disposed in the second housing hole 172.

The pressure chamber 133 is formed by the first housing hole 171, the first cover 170*b*, and the flow rate control spool 131. The flow rate control spool 131 is disposed such that one end portion in the axial direction (a left end portion in the drawing) of the flow rate control spool 131 faces the pressure chamber 133. Accordingly, the input pressure Pi outputted from the electromagnetic proportional control valve 21 acts on one end portion (the left end portion in the drawing) of the flow rate control spool 131.

The flow rate control spool 131 is divided into a first piece 136 and a second piece 137 in the axial direction of the flow rate control spool 131. The first piece 136 includes: a land portion 136*a* which slides in the first housing hole 171; and a circular columnar portion 136*b* which extends from the land portion 136*a* toward the second piece 137 in the axial direction.

The second piece 137 includes: a spring receiving portion 137*a* on which an end portion of the spring 132 abuts; and a circular columnar portion 137*b* which extends from the spring receiving portion 137*a* toward the first piece 136 in the axial direction.

The first piece 136 is biased in the +X direction by a pressure (input pressure Pi) of a working oil in the pressure chamber 133. The second piece 137 is biased in the −X direction by an elastic force of the spring 132. A stepped portion which abuts on the spring receiving portion 137*a* is formed in the second housing hole 172, and the stepped portion restricts the movement of the second piece 137 in the −X direction. The flow rate control spool 131 moves in the axial direction while maintaining a state where the circular columnar portion 136*b* of the first piece 136 and the circular columnar portion 137*b* of the second piece 137 abut on each other.

As illustrated in FIG. 4A, an outer diameter of the circular columnar portion 136*b* of the first piece 136 is smaller than an outer diameter of the circular columnar portion 137*b* of the second piece 137. Accordingly, a stepped portion 138 is formed between the circular columnar portion 136*b* and the circular columnar portion 137*b*. The stepped portion 138 is a portion which abuts on a first contact portion 151*a* of the feedback lever 150 described later.

Figure 4B:
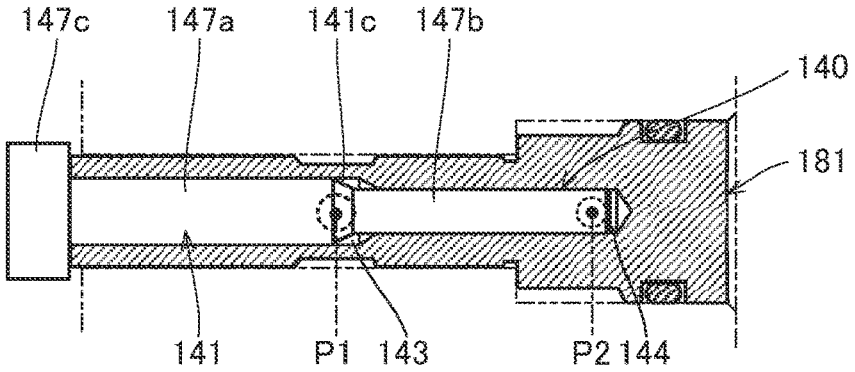
FIG. 4B is a partially enlarged view of FIG. 4A illustrating a second piece of a power control spool.

As illustrated in FIG. 4A and FIG. 4B, the power control mechanism 140 includes: a first pressure chamber 143 into which the discharge pressure P1 in the pump 10 is introduced; a second pressure chamber 144 into which the discharge pressure P2 in another pump (not shown) different from the pump 10 is introduced; the power control spool 141 which shifts corresponding to the discharge pressure P1 and the discharge pressure P2; and springs 142*a*, 142*b* serving as biasing members for biasing the power control spool 141 against pressures in the first pressure chamber 143 and the second pressure chamber 144.

As illustrated in FIG. 4A, the power control spool 141 is disposed parallel to the X axis. One end side (the left end side in the drawing) of the power control spool 141 is slidably housed in the third housing hole 173 formed in the first block 176 of the regulator housing 170. The other end side (the right end side in the drawing) of the power control spool 141 is slidably housed in a sleeve 181 mounted in the fourth housing hole 174 formed in the second block 177 of the regulator housing 170. The springs 142*a*, 142*b* are disposed in the third housing hole 173.

As illustrated in FIG. 4B, the power control spool 141 includes a large diameter portion 147*a*, and a small diameter portion 147*b* having a smaller outer diameter than the large diameter portion 147*a*. A stepped portion 141*c* is formed between the large diameter portion 147*a* and the small diameter portion 147*b*. A slide hole in which the large diameter portion 147*a* slides and a slide hole in which the small diameter portion 147*b* slides are formed in the sleeve 181. The first pressure chamber 143 is formed by the sleeve 181, the stepped portion 141*c*, and the small diameter portion 147*b*. The second pressure chamber 144 is formed by the sleeve 181 and the small diameter portion 147*b*.

The power control spool 141 is disposed such that the stepped portion 141*c* faces the first pressure chamber 143, and the small diameter portion 147*b* faces the second pressure chamber 144. Accordingly, the discharge pressure P1 of the pump 10 acts on the stepped portion 141*c* between the large diameter portion 147*a* and the small diameter portion 147*b* of the power control spool 141. The discharge pressure P2 of another pump (not illustrated in the drawing) which is a pump different from the pump 10 acts on the small diameter portion 147*b* of the power control spool 141.

As illustrated in FIG. 4A, the power control spool 141 is divided into a first piece 146 and a second piece 147 in an axial direction of the power control spool 141. The first piece 146 includes: a slide portion 146*a* which slides in the third housing hole 173; a circular columnar portion 146*b* which extends from the slide portion 146*a* toward the second piece 147 in the axial direction; and a spring receiving portion 146*c* on which end portions of the springs 142*a*, 142*b* abut.

The second piece 147 includes: a circular plate portion 147*c* disposed in the housing chamber 179; a large diameter portion 147*a* which extends from the circular plate portion 147*c* in the +X direction; and a small diameter portion 147*b* which extends from the large diameter portion 147*a* in the +X direction.

An outer diameter of the circular plate portion 147*c* is larger than an opening diameter of the sleeve 181. The circular plate portion 147*c* abuts on an end portion of the sleeve 181 so as to restrict the movement of the second piece 147 in the +X direction.

The second piece 147 is biased in the −X direction by a pressure (discharge pressure P1) of a working oil in the first pressure chamber 143 and a pressure (discharge pressure P2) of a working oil in the second pressure chamber 144. The second piece 137 is biased in the +X direction by elastic forces of the springs 142*a*, 142*b*. A stepped portion which abuts on the spring receiving portion 146*c* is formed in the third housing hole 173, and the stepped portion restricts the movement of the first piece 146 in the +X direction. The power control spool 141 moves in the axial direction while maintaining a state where the circular columnar portion 146*b* of the first piece 146 and the circular plate portion 147*c* of the second piece 147 abut on each other.

An outer diameter of the circular columnar portion 146*b* of the first piece 146 is smaller than an outer diameter of the circular plate portion 147*c* of the second piece 147. Accordingly, a stepped portion 148 is formed between the circular columnar portion 146*b* and the circular plate portion 147*c*. The stepped portion 148 is a portion which abuts on a second contact portion 151*b* of the feedback lever 150 described later.

As illustrated in FIG. 3, the control pressure regulating spool 121 of the control pressure regulating valve 120 is disposed parallel to the X axis. The control pressure regulating spool 121 is slidably housed in the fifth housing hole 175 formed in the first block 176 of the regulator housing 170. A retainer 182 is mounted on an end portion of the fifth housing hole 175 on a first cover 170*b* side. The spring 126 is disposed between the retainer 182 and the control pressure regulating spool 121. The control pressure regulating spool 121 is biased by the spring 126 in the direction toward the housing chamber 179 (+X direction).

The control pressure regulating valve 120 has a drain chamber 129 which communicates with the tank 19. The drain chamber 129 is formed by an end portion of the control pressure regulating spool 121 on a −X direction side, the fifth housing hole 175, and the retainer 182. The above-mentioned spring 126 is housed in the drain chamber 129.

In this embodiment, the tank port 124 is formed in the control pressure regulating spool 121. The drain chamber 129 communicates with the housing chamber 179 through the tank port 124 of the control pressure regulating spool 121. The housing chamber 179 communicates with the tank 19 through a drain passage (not illustrated in the drawing) formed in the pump housing 30.

The control pressure regulating spool 121 has a first land portion 121*a* and a second land portion 121*b* which slide in the fifth housing hole 175. The first land portion 121*a* is formed with a size which allows the first land portion 121*a* to close the control pressure port 125. The second land portion 12 *b* is formed on a housing chamber 179 side with respect to the first land portion 121*a*. An annular groove 121*c* is formed between the first land portion 121*a* and the second land portion 121 *b*.

When the control pressure regulating spool 121 moves, the pump port 123 or the tank port 124 selectively communicates with the control pressure port 125 so that the control pressure Pc in the large diameter side chamber 113 is regulated.

The control pressure regulating spool 121 has the connecting portion 127 which extends in the axial direction from the second land portion 12 *b* toward a housing chamber 179 side. The connecting portion 127 protrudes into the housing chamber 179 from the second land portion 121*b*, and a protruding end portion of the connecting portion 127 is rotatably connected to the feedback lever 150.

As illustrated in FIG. 3, FIG. 4A and FIG. 5, the feedback lever 150 includes a body portion 152 which is a rod-like member, a connecting pin 153 and a contact pin 151. The connecting pin 153 and the contact pin 151 are fixed to the body portion 152. A connecting portion 152*a* which is connected to the connecting groove 115*c* formed on the servo piston 110 is formed on one end portion in the axial direction (lower end portion illustrated in FIG. 5) of the body portion 152 of the feedback lever 150. The contact pin 151 serving as a contact portion selectively abutting on either the flow rate control spool 131 or the power control spool 141 is fixed to the other end portion in the axial direction (upper end portion in FIG. 5) of the body portion 152 of the feedback lever 150. Further, the connecting pin 153 serving as a connecting portion connected to the control pressure regulating spool 121 is fixed to a center portion in the axial direction of the body portion 152 of the feedback lever 150.

An insertion hole 152*b* is formed in a center portion in the axial direction of the body portion 152 of the feedback lever 150 in a penetrating manner in the X axis direction. The connecting portion 127 of the control pressure regulating spool 121 is allowed to pass through the insertion hole 152*b*. The connecting pin 153 is inserted into a through hole which is formed in the feedback lever 150 in a penetrating manner in the Y axis direction. The connecting portion 127 of the control pressure regulating spool 121 is formed in a shape where a distal end of the connecting portion 127 is bifurcated in a U shape, and the connecting pin 153 is rotatably connected to a recessed portion of the connecting portion 127.

The contact pin 151 is allowed to pass through a through hole which is formed in the body portion 152 of the feedback lever 150 in a penetrating manner in the Y axis direction, and forms a portion of the feedback lever 150. The contact pin 151 includes: the first contact portion 151*a* which protrudes from the through hole toward a flow rate control spool 131 side; and the second contact portion 151*b* which protrudes from the through hole toward a power control spool 141 side.

The first contact portion 151*a* is disposed such that an outer peripheral surface (side surface) of the first contact portion 151*a* faces the stepped portion 138 of the flow rate control spool 131. The second contact portion 151 *b* is disposed on a side opposite to the first contact portion 151*a*, and an outer peripheral surface (side surface) of the second contact portion 151*b* faces the stepped portion 148 of the power control spool 141.

The flow rate control spool 131 and the power control spool 141 are disposed such that the flow rate control spool 131 and the power control spool 141 are disposed parallel to the servo piston 110, and face each other with the other end portion in the axial direction (upper end portion illustrated in FIG. 5) of the feedback lever 150 sandwiched between the flow rate control spool 131 and the power control spool 141 in the direction (Y axis direction) orthogonal to the servo piston 110. In other words, when the pump displacement control device 100 is viewed in the Y axis direction, the flow rate control spool 131, the other end portion in the axial direction (the upper end portion illustrated in FIG. 5) of the feedback lever 150, and the power control spool 141 are disposed in an overlapping manner.

In this manner, the flow rate control spool 131 and the power control spool 141 are disposed such that the flow rate control spool 131 and the power control spool 141 are each disposed parallel to the servo piston 110, and face each other with the feedback lever 150 sandwiched in the radial direction between the flow rate control spool 131 and the power control spool 141. Accordingly, compared to a case where the respective spools 131, 141 are disposed on one straight line such that the flow rate control spool 131 and the power control spool 141 are disposed coaxially, the miniaturization of the pump displacement control device 100 in the axial direction can be realized.

The position of the flow rate control spool 131 is set by a force which pushes the flow rate control spool 131 in the +X direction by a working oil having the input pressure Pi and a force which pushes the flow rate control spool 131 in the −X direction by the spring 132. When the input pressure Pi is lower than a predetermined pressure, as illustrated in FIG. 3 and FIG. 4A, the flow rate control spool 131 is positioned at an initial position where the spring receiving portion 137*a* abuts on the stepped portion of the second housing hole 172.

In such a state, the first contact portion 151*a* of the feedback lever 150 abuts on the stepped portion 138 of the flow rate control spool 131. Accordingly, the feedback lever 150 is pushed in the −X direction by the flow rate control spool 131. As described above, the control pressure regulating spool 121 is connected to the feedback lever 150, and the control pressure regulating spool 121 is pushed in the +X direction by the spring 126. Accordingly, the feedback lever 150 is pushed in the −X direction by the flow rate control spool 131 and, at the same time, is pushed in the +X direction by the control pressure regulating spool 121.

The position of the power control spool 141 is set by a force which pushes the power control spool 141 in the −X direction by a working oil having the discharge pressure P1 and the working oil having the discharge pressure P2, and a force which pushes the power control spool 141 in the +X direction by the springs 142*a*, 142*b*. When the discharge pressure P1 and the discharge pressure P2 are each lower than predetermined pressures, the power control spool 141 is, as illustrated in FIG. 4A, positioned at an initial position where the spring receiving portion 146*c* abuts on the stepped portion of the third housing hole 173.

In such a state, the stepped portion 148 of the power control spool 141 and the second contact portion 151*b* of the feedback lever 50 are spaced apart from each other by a distance X1 (0<X1). That is, the second contact portion 151*b* of the feedback lever 150 does not abut on the stepped portion 148 of the power control spool 141.

As described above, the feedback lever 150 is pushed in the −X direction by the flow rate control spool 131 and hence, the control pressure regulating spool 121 is pushed in the −X direction by the feedback lever 150. Accordingly, as illustrated in FIG. 3, the control pressure regulating spool 121 is maintained at the pump communication position where the pump port 123 and the control pressure port 125 communicate with each other through the annular groove 121*c* in the initial state.

In the state where the control pressure regulating spool 121 is maintained in the pump communication position, a pressure (control pressure Pc) in the large diameter side chamber 113 is equal to the discharge pressure P1 of the pump 10. In such a state, as illustrated in FIG. 2, the servo piston 110 is positioned at an initial position where the small diameter portion 112 abuts on a plug 35 which closes the opening of the piston housing portion 118, and sets the tilt angle of the swash plate 15 such that the pump displacement becomes a minimum value.

The operation of the pump device 1 when the flow rate control is performed is described.

Figure 6:
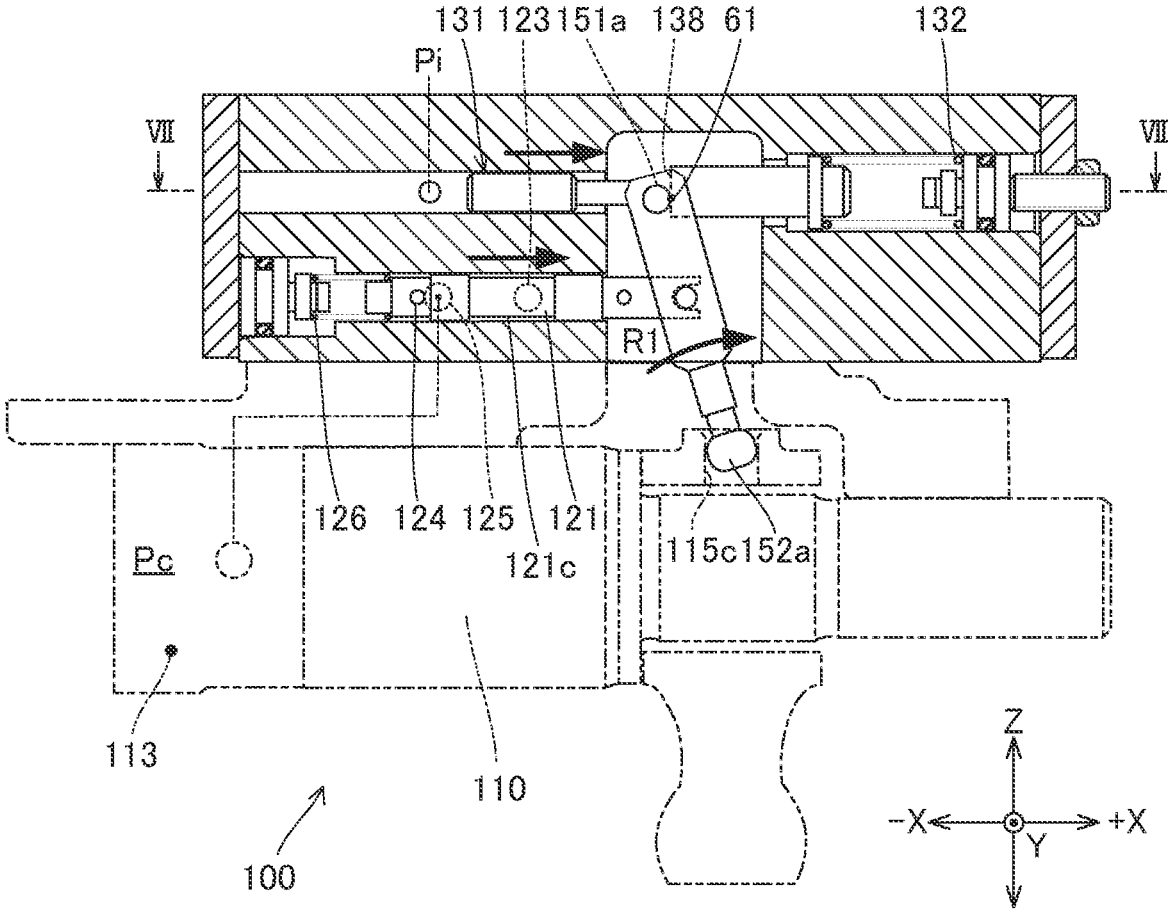
FIG. 6 is a view for describing an operation of the pump displacement control device in a flow rate control state illustrating a state immediately after starting a manipulation of a lever.
Figure 7:
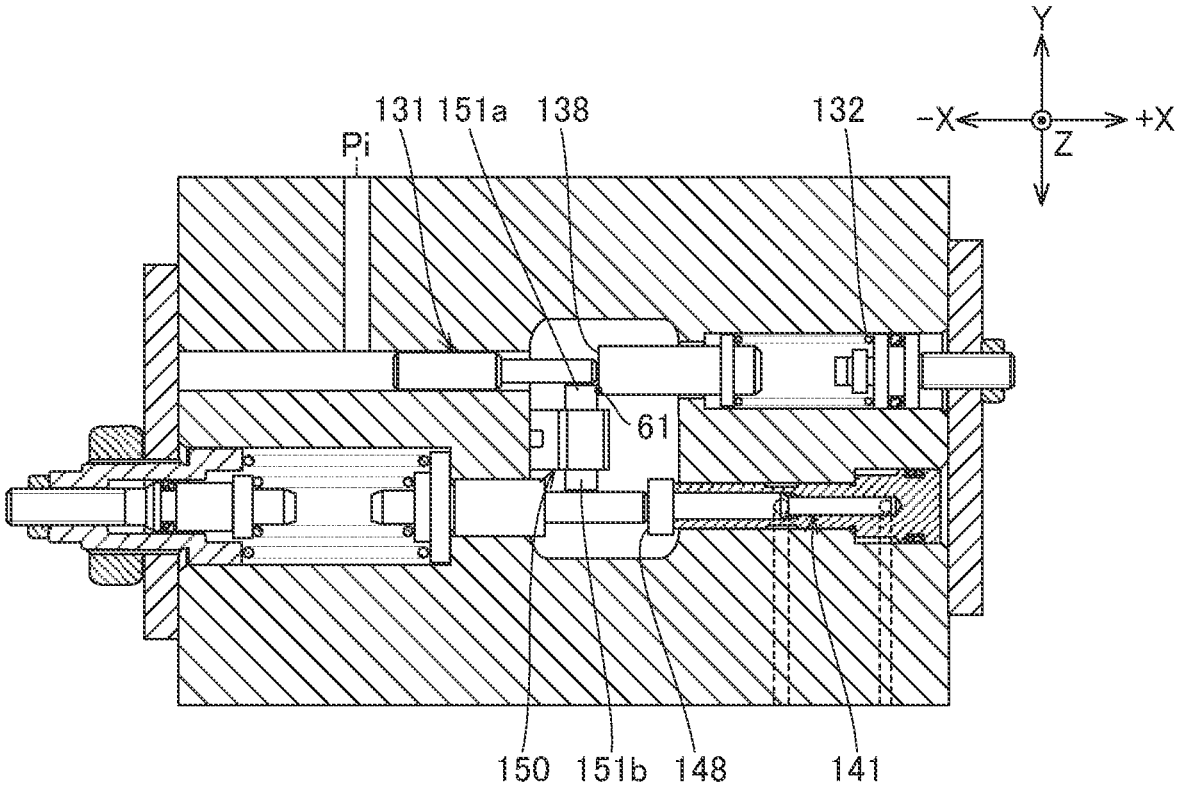
FIG. 7 is a cross-sectional view taken along a line VII-VII in FIG. 6.

As illustrated in FIG. 2, when the manipulation lever is manipulated so that a control current outputted from the controller 20 to a solenoid of the electromagnetic proportional control valve 21 is increased, the input pressure Pi inputted to the pressure chamber 133 of the flow rate control mechanism 130 rises. When the input pressure Pi rises, as illustrated in FIG. 6, the flow rate control spool 131 is moved by pushing from the initial position (see FIG. 3 and FIG. 4A) in the +X direction by the working oil in the pressure chamber 133. As illustrated in FIG. 7, the flow rate control spool 131 stops at a position where a force which pushes the flow rate control spool 131 in the +X direction by a working oil of the input pressure Pi and a force which pushes the flow rate control spool 131 in the −X direction by the spring 132 are balanced.

In such a manipulation, since the control pressure regulating spool 121 is biased in the +X direction by the spring 126, when the flow rate control spool 131 moves from the initial position in the +X direction, as illustrated in FIG. 6, the control pressure regulating spool 121 is moved by pushing in the +X direction by the spring 126. That is, the control pressure regulating spool 121 moves in the +X direction following the movement of the flow rate control spool 131. Since the control pressure regulating spool 121 pushes the feedback lever 150 in the +X direction, when the flow rate control spool 131 moves in the +X direction, the feedback lever 150 rotates in an R1 direction (clockwise direction in the drawing) using the connecting portion 152*a* as a fulcrum. In such a state, a contact state between the first contact portion 151*a* of the feedback lever 150 and the stepped portion 138 of the flow rate control spool 131 is maintained.

Figure 8:
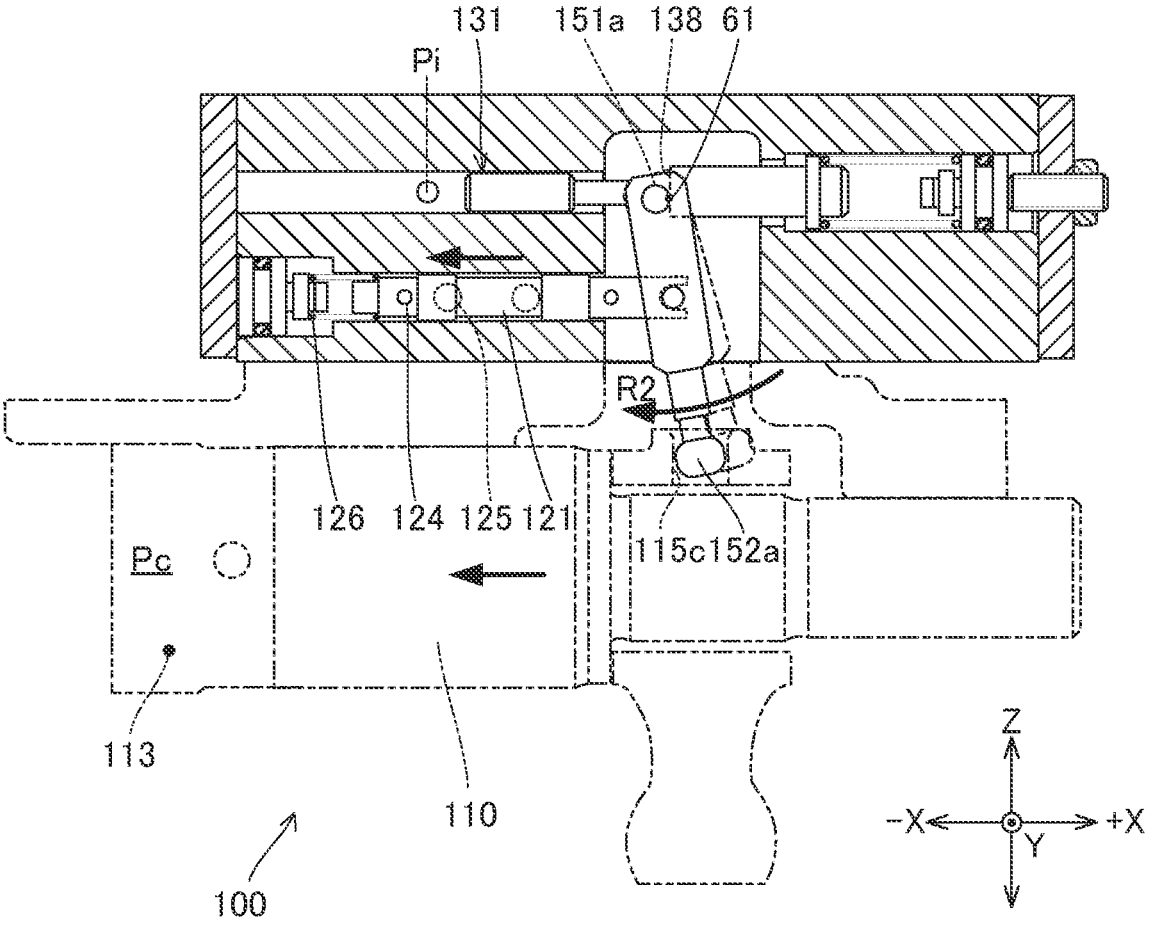
FIG. 8 is a view for describing an operation of the pump displacement control device in a flow rate control state illustrating an operation in which a displacement of a servo piston is fed back to a control pressure regulating spool by a feedback lever.

When the control pressure regulating spool 121 moves in the +X direction so that a position of the control pressure regulating spool 121 is switched to the tank communication position where the tank port 124 and the control pressure port 125 communicate with each other, a working oil is discharged from the large diameter side chamber 113 into the tank 19 so that the control pressure Pc is lowered. When the control pressure Pc is lowered, as illustrated in FIG. 8, the servo piston 110 moves in the −X direction so that the tilt angle of the swash plate 15 is increased. That is, the pump displacement is increased.

When the servo piston 110 moves in the −X direction, the feedback lever 150 rotates in an R2 direction (clockwise direction in the drawing) about an upper side fulcrum 61 (see also FIG. 7) which is a contact point between the first contact portion 151*a* of the feedback lever 150 and the stepped portion 138 of the flow rate control spool 131. When the feedback lever 150 rotates in the R2 direction, the control pressure regulating spool 121 is moved by pushing in the −X direction by the feedback lever 150.

When the control pressure regulating spool 121 is switched to the pump communication position with such a manipulation, a pressure (control pressure Pc) of the large diameter side chamber 113 is increased and hence, the servo piston 110 moves in the +X direction again and the tilt angle of the swash plate 15 is decreased. That is, the pump displacement is decreased. The servo piston 110 repeats the operation where the control pressure regulating spool 121 is switched between the pump communication position and the tank communication position until the pump displacement takes a value corresponding to a manipulation variable of the manipulation lever (hereinafter referred to as a target value). When a predetermined time elapses, the control pressure regulating spool 121 is maintained at the interruption position, and a steady state where the pump displacement is maintained at the target value is acquired.

Figure 9:
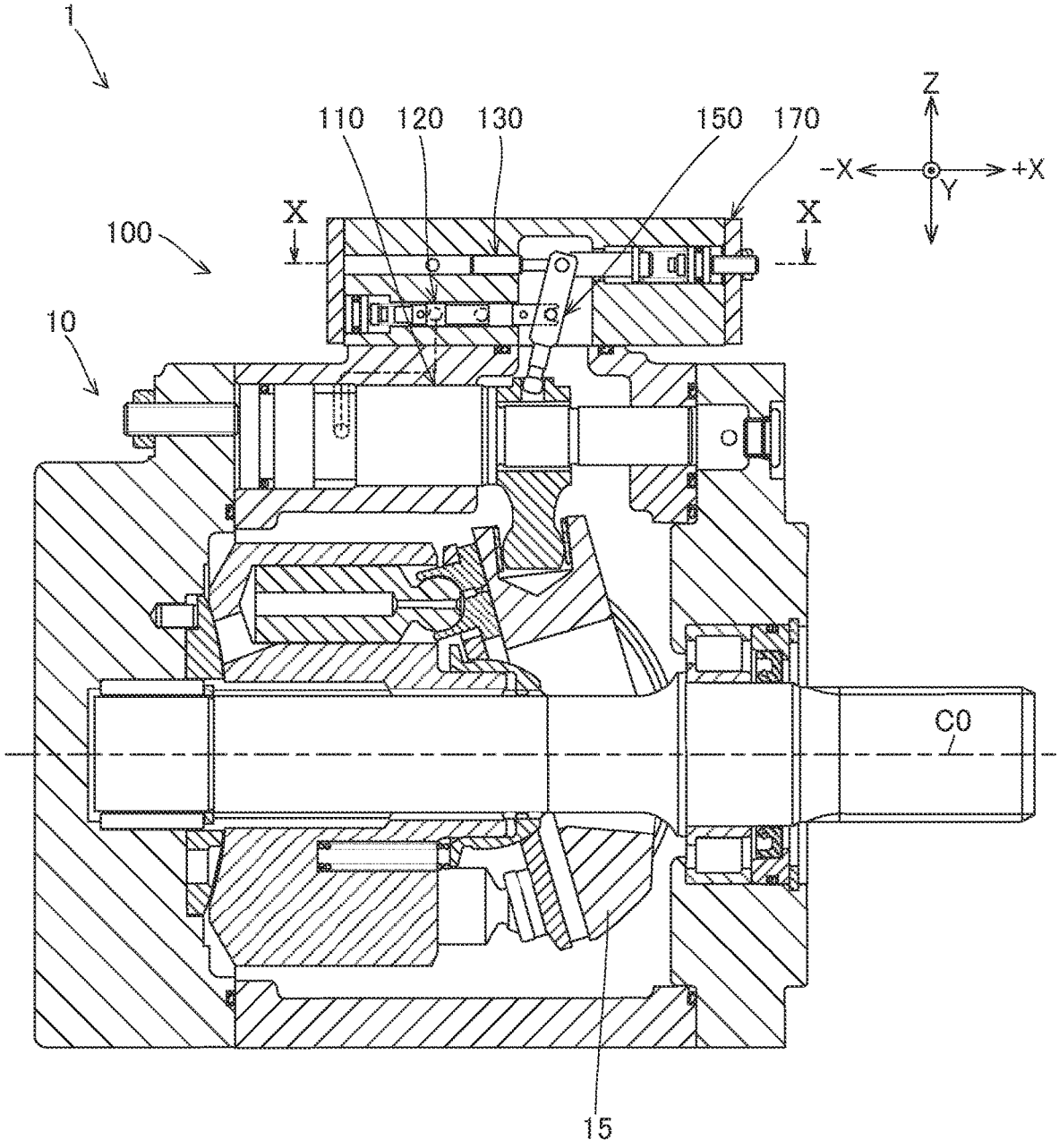
FIG. 9 is a cross-sectional view of the pump device illustrating a state where the displacement of the pump is maximum.
Figure 10:
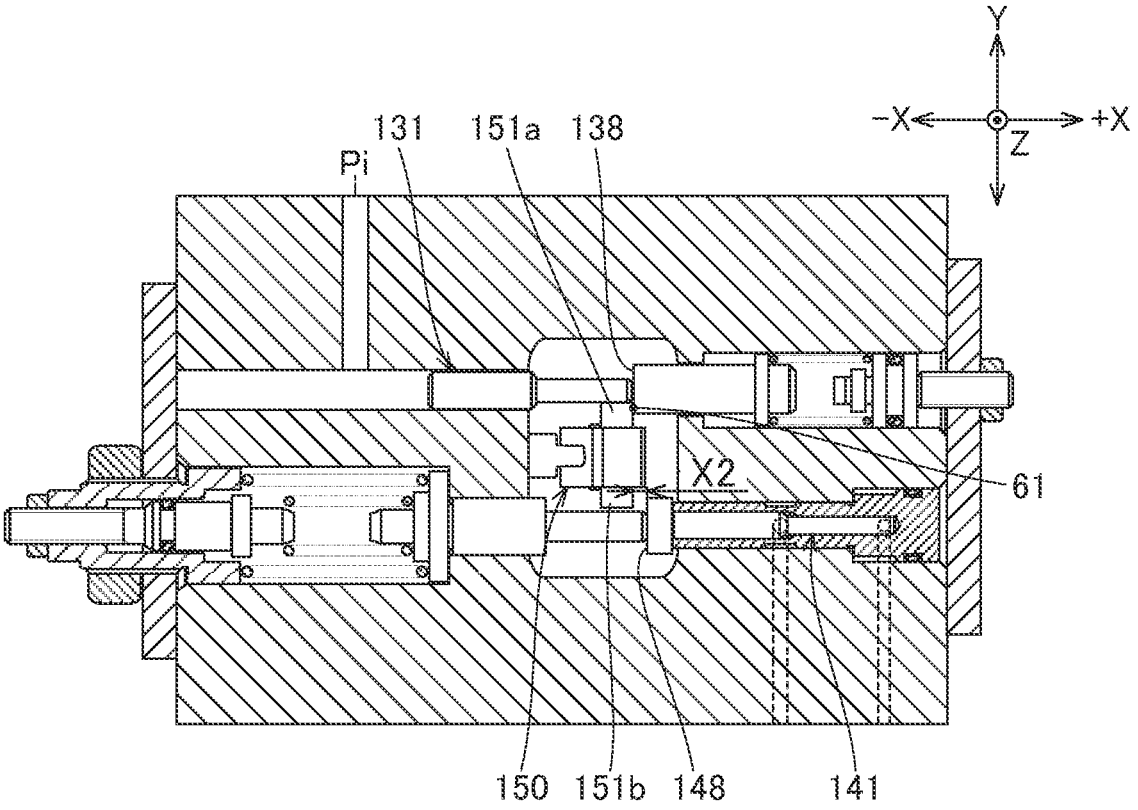
FIG. 10 is a cross-sectional view taken along a line X-X in FIG. 9.

FIG. 9 and FIG. 10 illustrate a state where the pump displacement becomes maximum. In this embodiment, when the discharge pressure P1 and the discharge pressure P2 are lower than predetermined pressures in a state where the pump displacement becomes maximum, that is, when the tilt angle of the swash plate 15 becomes a maximum angle, the feedback lever 150 does not abut on the power control spool 141. That is, the second contact portion 151 *b* of the feedback lever 150 and the stepped portion 148 of the power control spool 141 are spaced apart from each other by a distance X2 (0<X2<X1).

Figure 11:
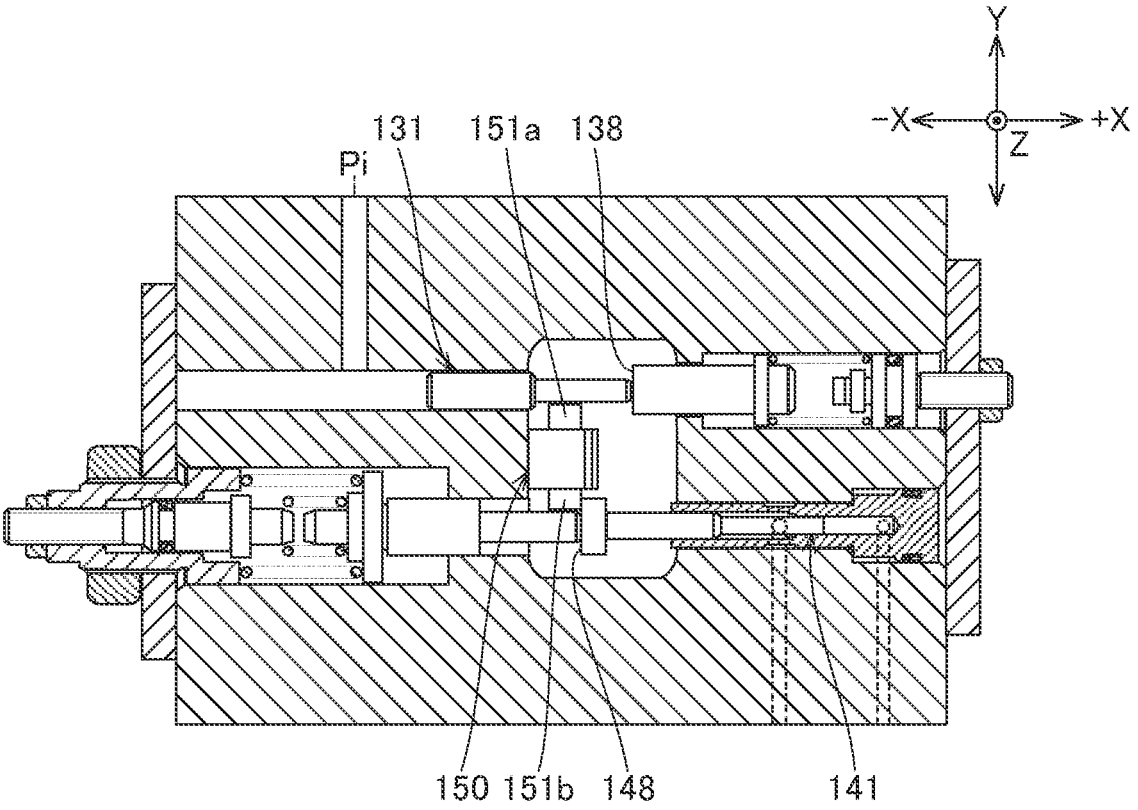
FIG. 11 is a view for describing an operation of the pump displacement control device in a power control state.

Next, the operation of the pump device 1 when the power control is performed is described. For example, in a state where the pump displacement is at maximum (see FIG. 9 and FIG. 10), when the discharge pressure P1 and/or the discharge pressure P2 are/is higher than predetermined pressures or a predetermined pressure, the power control spool 141 moves in the −X direction, and the stepped portion 148 of the power control spool 141 abuts on the second contact portion 151 *b* of the feedback lever 150. As illustrated in FIG. 11, when the feedback lever 150 is moved by pushing in the −X direction by the stepped portion 148 of the power control spool 141, the control pressure regulating spool 121 is moved by pushing in the −X direction. Further, the flow rate control spool 131 and the first contact portion 151*a* of the feedback lever 150 are spaced apart from each other.

When the control pressure regulating spool 121 moves in the −X direction so that the control pressure regulating spool 121 is switched to the pump communication position where the pump port 123 and the control pressure port 125 communicate with each other, a pressure (control pressure Pc) of the large diameter side chamber 113 is increased so that the servo piston 110 moves in the +X direction whereby the tilt angle of the swash plate 15 is decreased. That is, the pump displacement is decreased.

In the same manner as the above-mentioned flow rate control, the feedback lever 150 feedbacks the displacement of the servo piston 110 to the control pressure regulating spool 121.

In this embodiment, the flow rate control is performed in a state where the first contact portion 151*a* serving as a portion of the feedback lever 150 and the stepped portion 138 of the flow rate control spool 131 abut on each other. In the flow rate control, the displacement of the flow rate control spool 131 is transmitted to the control pressure regulating spool 121 by way of the feedback lever 150 and hence, a control pressure Pc is regulated corresponding to the displacement of the flow rate control spool 131. When the discharge pressures P1, P2 are increased, the second contact portion 151*b* serving as a portion of the feedback lever 150 and the stepped portion 148 of the power control spool 141 abut on each other and hence, the flow rate control is switched to the power control. In the power control, the displacement of the power control spool 141 is transmitted to the control pressure regulating spool 121 by way of the feedback lever 150 so that the control pressure Pc is regulated corresponding to the displacement of the power control spool 141. In the power control state, the tilt angle of the swash plate 15 is controlled such that the pump displacement becomes lower than the target value of the pump displacement corresponding to a control current set by the controller 20.

According to the embodiment described above, advantages shown below can be afforded.

(1) A control pressure Pc is regulated in such a manner that the feedback lever 150 directly abuts on either one of the flow rate control spool 131 or the power control spool 141 not by way of an additional member such as a lever. Accordingly, an operation of the flow rate control spool 131 and an operation of the power control spool 141 are speedily transmitted to the control pressure regulating spool 121 by way of the feedback lever 150 and hence, an operation responsiveness of the control pressure regulating spool 121 can be enhanced. As a result, the displacement of the pump 10 can be properly controlled. Further, the simple configuration is adopted where the flow rate control spool 131 and the power control spool 141 directly abut on the feedback lever 150 and hence, a cost of the pump displacement control device 100 can be reduced. That is, in the present embodiment, the pump displacement control device 100 which can properly control the displacement of the pump 10 can be provided at a low cost.

(2) The control pressure regulating spool 121 regulates a control pressure Pc for controlling the servo piston 110 corresponding to the displacement of one spool which decreases the displacement of the pump 10 out of the flow rate control spool 131 and the power control spool 141. Accordingly, when discharge pressures P1, P2 of the pump 10 are increased in a state where the flow rate control is being performed, the power control is performed in place of the flow rate control and the tilt angle of the pump 10 is decreased and hence, an overload applied to a drive source (engine 5) of the pump 10 can be prevented.

The following modifications also fall within the scope of the present invention, and the configurations described in the modifications and the configuration described in the above-mentioned embodiment may be combined with each other or constitutional elements which are described in the different modifications described hereinafter may be combined with each other.

<Modification 1>

Figure 12:
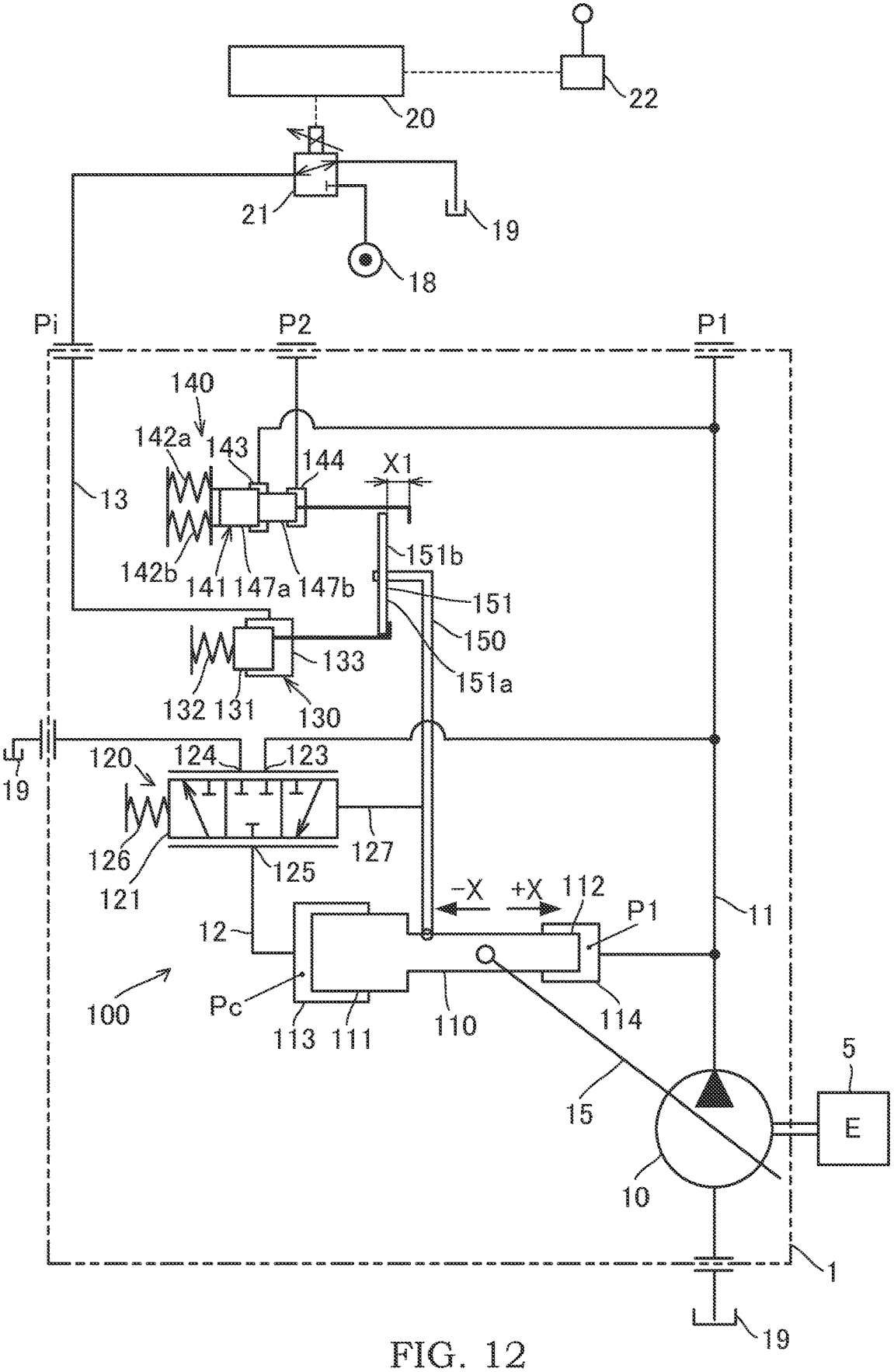
FIG. 12 is a hydraulic circuit diagram illustrating the configuration of a pump device provided with a pump displacement control device according to a modification of the present embodiment.

In the above-mentioned embodiment, the description has been made with respect to the example in which a positive flow rate control where the displacement of the pump 10 is increased is performed in proportional to the increase of the input pressure Pi. However, the present invention is not limited to such an embodiment. As illustrated in FIG. 12, a negative flow rate control in which the displacement of the pump 10 is decreased in proportion to the increase of the input pressure Pi may be performed. In this case, the arrangement relationship between the pressure chamber 133 and the spring 132 provided for biasing the flow rate control spool 131 may be set opposite to the corresponding arrangement relationship in the above-mentioned embodiment. That is, the spring 132 is disposed in the first housing hole 171 in the above-mentioned embodiment, and the input pressure Pi is introduced into the second housing hole 172 in the above-mentioned embodiment.

More specifically, in the above-mentioned embodiment (see FIG. 1 and the like), the configuration is adopted where the flow rate control spool 131 is biased in the +X direction by a pressure (input pressure Pi) of a working oil in the pressure chamber 133 and the flow rate control spool 131 is biased in the −X direction by an elastic force of the spring 132. Accordingly, when the input pressure Pi rises in a state where the displacement of the pump 10 is minimum, the flow rate control spool 131 moves in the +X direction and the control pressure regulating spool 121 moves in the +X direction so that a working oil is discharged from the large diameter side chamber 113 to the tank 19 through the control pressure regulating valve 120 whereby a control pressure Pc is lowered. When the control pressure Pc is lowered, the servo piston 110 moves in the −X direction so that the tilt angle of the swash plate 15 is increased. That is, the pump displacement is increased.

On the other hand, in the modification as illustrated in FIG. 12, the configuration is adopted where the flow rate control spool 131 is biased in the −X direction by a pressure (input pressure Pi) of a working oil in the pressure chamber 133, and is biased in the +X direction by an elastic force of the spring 132. Accordingly, when the input pressure Pi is lowered in a state where the displacement of the pump 10 is minimum, the flow rate control spool 131 moves in the +X direction and the control pressure regulating spool 121 moves in the +X direction so that a working oil is discharged from the large diameter side chamber 113 to the tank 19 through the control pressure regulating valve 120 whereby a control pressure Pc is lowered. When the control pressure Pc is lowered, the servo piston 110 moves in the −X direction so that the tilt angle of the swash plate 15 is increased. That is, the pump displacement is increased.

In the same manner as the above-mentioned embodiment, the flow rate control spool 131 and the power control spool 141 are disposed such that the flow rate control spool 131 and the power control spool 141 are each disposed parallel to the servo piston 110, and face each other with the feedback lever 150 sandwiched between the flow rate control spool 131 and the power control spool 141.

<Modification 2>

In the above-mentioned embodiment, the description has been made with respect to the example where the pump 10 is a swash plate type piston pump where the displacement of the pump 10 is defined by controlling the tilt angle of the swash plate 15. However, the present invention is not limited to such an example. The pump 10 may be a swash-axis-type piston pump where the displacement of the pump 10 is defined by controlling a tilt angle of a swash axis.

<Modification 3>

In the above-mentioned embodiment, the description has been made with respect to the example where the controller 20 regulates the input pressure Pi using the electromagnetic proportional control valve 21. However, the present invention is not limited to such an example. A pilot pressure outputted corresponding to a manipulation variable of a manipulation lever manipulated by an operator may be used as the input pressure Pi. In this case, the electromagnetic proportional control valve 21 can be omitted.

<Modification 4>

In the above-mentioned embodiment, the description has been made with respect to the example where one end portion of the contact pin 151 which is allowed to pass through the feedback lever 150 forms the first contact portion 151*a*, and the other end portion of the contact pin 151 forms the second contact portion 151*b*. However, the present invention is not limited to such an example. The first contact portion 151*a* and the second contact portion 151 *b* may be formed on the feedback lever 150 by integral molding. That is, the feedback lever 150 which has the first contact portion 151*a* and the second contact portion 151 *b* may be formed as a single part.

<Modification 5>

The arrangement relationship between the first contact portion 151*a* and the second contact portion 151*b* is not limited to the above-mentioned embodiment. For example, the first contact portion 151*a* is disposed, in the same manner as the above-mentioned embodiment, orthogonal to the body portion 152 of the feedback lever 150, and the second contact portion 151*b* may be disposed such that the second contact portion 151*b* extends from a distal end of the feedback lever 150 in the axial direction. It is sufficient that the pump displacement control device 100 has the configuration where the feedback lever 150 directly abuts on one spool which decreases the displacement of the pump 10 out of the flow rate control spool 131 and the power control spool 141. The contact portion between the spool and the feedback lever 150 can be set at various positions.

<Modification 6>

In the above-mentioned embodiment, the description has been made with respect to the example where the power control is performed on the basis of discharge pressures P1, P2 of two pumps (the pump 10 and another pump different from the pump 10) which are driven by the engine 5. However, the present invention is not limited to such an example. In a case where the pump driven by the engine 5 is formed of only the pump 10 illustrated in FIG. 1, the second pressure chamber 144 described in the above-mentioned embodiment can be omitted.

<Modification 7>

Figure 13:
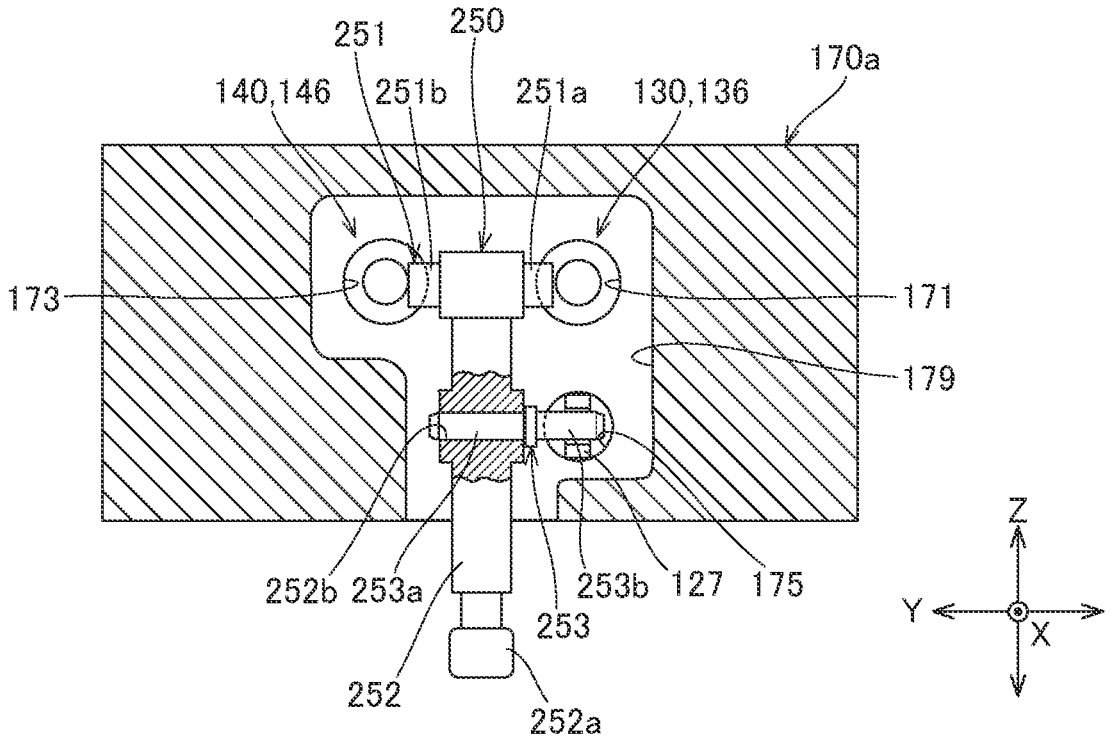
FIG. 13 is a cross-sectional view illustrating a pump displacement control device according to a modification of present embodiment and corresponds to FIG. 5.

In the above-mentioned embodiment, as illustrated in FIG. 5, the fifth housing hole 175 which houses the control pressure regulating spool 121 is disposed in a spaced apart manner from the first housing hole 171 which houses one end of the flow rate control spool 131 and the third housing hole 173 which houses one end of the power control spool 141 by a predetermined distance in the Z axis direction, and is disposed to be positioned substantially at the center between the first housing hole 171 and the third housing hole 173 in the Y axis direction. In place of such a configuration, as illustrated in FIG. 13, the fifth housing hole 175 may be disposed such that the position of the fifth housing hole 175 in the Y axis direction is substantially aligned with the position of the first housing hole 171. FIG. 13 is a drawing illustrating the above-mentioned modification of the above-mentioned embodiment, and illustrates a cross section corresponding to the cross section illustrated in FIG. 5.

A feedback lever 250 in this modification includes a body portion 252 which is a rod-like member, a connecting pin 253, and a contact pin 251. A connecting portion 252*a* which is connected to the connecting groove 115*c* of the servo piston 110 is formed on one end portion in an axial direction (a lower end portion illustrated in FIG. 13) of the body portion 252. The contact pin 251 serving as a contact portion which selectively abuts on the flow rate control spool 131 or the power control spool 141 is fixed to the other end portion in the axial direction (an upper end portion illustrated in FIG. 13) of the body portion 252. The connecting pin 253 serving as a connecting portion which is connected to the control pressure regulating spool 121 is fixed to a center portion in the axial direction of the body portion 252.

More specifically, a through hole 252*b* is formed in a center portion in the axial direction of the body portion 252 of the feedback lever 250 in a penetrating manner in the Y axis direction. One end portion 253*a* of the connecting pin 253 is allowed to pass through the through hole 252*b*. The connecting portion 127 of the control pressure regulating spool 121 is formed in a U shape such that the distal end of the connecting portion 127 is bifurcated. The other end portion 253*b* of the connecting pin 253 protruding in the Y axis direction from the body portion 252 of the feedback lever 250 is rotatably connected to the recessed portion of the connecting portion 127.

In the same manner as the contact pin 151 in the above-mentioned embodiment, the contact pin 251 is allowed to pass through a through hole which penetrates the body portion 252 of the feedback lever 250 in the Y axis direction. The contact pin 251 includes: a first contact portion 251*a* which protrudes from the through hole toward the flow rate control spool 131 side; and a second contact portion 251 *b* which protrudes from the through hole toward the power control spool 141 side.

In this manner, by adopting the configuration where the position of the fifth housing hole 175 in the Y axis direction is substantially aligned with the position of the first housing hole 171, and the connecting pin 253 to which the connecting portion 127 of the control pressure regulating spool 121 is connected protrudes from the body portion 252 of the feedback lever 250, the feedback lever 250 may have a relatively simple shape where the contact pin 251 and the connecting pin 253 are allowed to pass through the body portion 252. Further, unlike the feedback lever 150 of the above-mentioned embodiment, it is unnecessary to form the insertion hole 152*b* which penetrates in the X axis direction in the feedback lever 250. Accordingly, working and assembling of the feedback lever 250 can be facilitated. As a result, a manufacturing cost of the pump displacement control device 100 can be reduced.

In this modification, the other end portion 253*b* of the connecting pin 253 extends toward a first housing hole 171 side and hence, the position of the fifth housing hole 175 in the Y axis direction is substantially aligned with the first housing hole 171. In place of such a configuration, the other end portion 253*b* of the connecting pin 253 may extend toward a third housing hole 173 side, and the position of the fifth housing hole 175 in the Y axis direction may be substantially aligned with the third housing hole 173.

In other words, it is sufficient that the position at which the fifth housing hole 175 is disposed in the Y axis direction is on an extension line of the connecting pin 253, and the connecting portion 127 of the control pressure regulating spool 121 can be connected to the connecting pin 253. However, in a case where the position at which the fifth housing hole 175 is disposed is spaced apart from the body portion 252 of the feedback lever 250, a length of the other end portion 253*b* of the connecting pin 253 is elongated thus giving rise to a concern that the displacement of the control pressure regulating spool 121 is not accurately transmitted to the feedback lever 250. In view of the above, the position at which the fifth housing hole 175 is disposed is preferably the position close to the body portion 252 of the feedback lever 250, for example, the position between the first housing hole 171 and the third housing hole 173 in the Y axis direction.

In this manner, according to this modification, the position of the fifth housing hole 175 can be suitably changed in conformity with the layout of the passages and the housing holes formed in the regulator housing 170. Accordingly, the degree of freedom in designing the pump displacement control device 100 can be enhanced.

The configuration, the manner of operation and the advantageous effects of the embodiment of the present invention having the above-mentioned configuration are recapitulated hereinafter.

The pump displacement control device 100 is a pump displacement control device for controlling the displacement of the pump 10. The pump displacement control device 100 includes: the servo piston 110 configured to change the tilt angle of the pump 10; the flow rate control spool 131 configured to be displaced corresponding to the input pressure Pi; the power control spool 141 configured to be displaced corresponding to discharge pressures P1, P2 of the pump 10; the control pressure regulating spool 121 configured to regulate a control pressure Pc which controls the servo piston 110 corresponding to a displacement of the flow rate control spool 131 and a displacement of the power control spool 141; and the feedback lever 150 connected to the servo piston 110 and the control pressure regulating spool 121, and configured to feedback a displacement of the servo piston 110 to the control pressure regulating spool 121, wherein the feedback lever 150 is configured to directly abut on either one of the flow rate control spool 131 or the power control spool 141 so as to regulate the control pressure Pc.

With such a configuration, the feedback lever 150 directly abuts on either one of the flow rate control spool 131 or the power control spool 141 not by way of an additional member such as a lever. Accordingly, the operation of the flow rate control spool 131 and the operation of the power control spool 141 are speedily transmitted to the control pressure regulating spool 121 by way of the feedback lever 150 and hence, an operational responsiveness of the control pressure regulating spool 121 can be enhanced. As a result, the displacement of the pump 10 can be properly controlled. Further, the simple configuration is adopted where the flow rate control spool 131 and the power control spool 141 directly abut on the feedback lever 150 and hence, a cost of the pump displacement control device 100 can be reduced. That is, according to such a configuration, it is possible to provide the pump displacement control device 100 capable of properly control the displacement of the pump 10 at a low cost.

In the pump displacement control device 100, the feedback lever 150 includes: the first contact portion 151*a* configured to abut on the stepped portion 138 of the flow rate control spool 131; and the second contact portion 151*b* disposed on a side opposite to the first contact portion 151*a* and configured to abut on the stepped portion 148 of the power control spool 141, wherein the flow rate control spool 131 and the power control spool 141 are disposed such that the flow rate control spool 131 and the power control spool 141 are each disposed parallel to the servo piston 110, and face each other with the feedback lever 150 sandwiched between the flow rate control spool 131 and the power control spool 141.

With such a configuration, the flow rate control spool 131 and the power control spool 141 are disposed such that the flow rate control spool 131 and the power control spool 141 are each disposed parallel to the servo piston 110, and face each other with the feedback lever 150 sandwiched between the flow rate control spool 131 and the power control spool 141. Accordingly, compared to a case where the flow rate control spool 131 and the power control spool 141 are disposed coaxially, the miniaturization of the pump displacement control device 100 in the axial direction can be realized.

In the pump displacement control device 100, the control pressure regulating spool 121 is configured to regulate a control pressure Pc corresponding to the displacement of one spool which decreases the displacement of the pump 10 out of the flow rate control spool 131 and the power control spool 141.

With such a configuration, in a case where discharge pressures P1, P2 of the pump 10 are increased when the flow rate control where a control pressure Pc is regulated corresponding to the displacement of the flow rate control spool 131 is performed, in place of the flow rate control, the power control where the control pressure Pc is regulated corresponding to the displacement of the power control spool 141 is performed so that the tilt angle of the pump 10 is decreased whereby an overload applied to the drive source (engine 5) of the pump 10 can be prevented.

Embodiments of the present invention were described above, but the above embodiments are merely examples of applications of the present invention, and the technical scope of the present invention is not limited to the specific constitutions of the above embodiments.

This application claims priority based on Japanese Patent Application No. 2019-55068 filed with the Japan Patent Office on Mar. 22, 2019, the entire contents of which are incorporated into this specification by reference.

The invention claimed is:

1. A pump displacement control device for controlling a displacement of a pump, the pump displacement control device comprising:

a servo piston configured to change a tilt angle of the pump;

a flow rate control spool configured to be displaced corresponding to an input pressure;

a power control spool configured to be displaced corresponding to a discharge pressure of the pump;

a control pressure regulating spool configured to regulate a control pressure which controls the servo piston in accordance with an amount of displacement of the flow rate control spool or an amount of displacement of the power control spool; and a feedback lever configured to selectively abut on the flow rate control spool or the power control spool, and directly connecting the servo piston to the control pressure regulating spool such that the feedback lever directly feeds back an amount of displacement of the servo piston to the control pressure regulating spool by abutting on either one of the flow rate control spool or the power control spool, whereby the control pressure regulating spool regulates the control pressure.

2. The pump displacement control device according to claim 1, wherein the control pressure regulating spool is configured to regulate the control pressure in accordance with the amount of the displacement of either one of the flow rate control spool or the power control spool, the one of the flow rate control spool or the power control spool being the one that decreases an amount of the displacement of the pump.

3. A pump displacement control device for controlling a displacement of a pump, the pump displacement control device comprising:

a servo piston configured to change a tilt angle of the pump;

a flow rate control spool configured to be displaced corresponding to an input pressure;

a power control spool configured to be displaced corresponding to a discharge pressure of the pump;

a control pressure regulating spool configured to regulate a control pressure which controls the servo piston in accordance with an amount of displacement of the flow rate control spool or an amount of displacement of the power control spool; and a feedback lever connected to the servo piston and the control pressure regulating spool, the feedback lever being configured to feedback an amount of displacement of the servo piston to the control pressure regulating spool, wherein the feedback lever is configured to directly abut on either one of the flow rate control spool or the power control spool for regulating the control pressure, the feedback lever has:

a first contact portion configured to abut on a stepped portion of the flow rate control spool; and a second contact portion disposed on a side opposite to the first contact portion, the second contact portion configured to abut on a stepped portion of the power control spool, and the flow rate control spool and the power control spool are disposed such that the flow rate control spool and the power control spool are each disposed parallel to the servo piston and face each other with the feedback lever sandwiched between the flow rate control spool and the power control spool.

* * * * *